US006820769B2

(12) United States Patent
Foster et al.

(10) Patent No.: US 6,820,769 B2
(45) Date of Patent: Nov. 23, 2004

(54) CHILD PROOF CONNECTION FOR REMOTE TRIGGER SPRAYER AND BOTTLE CONTAINER

(75) Inventors: Donald D. Foster, St. Charles, MO (US); Philip L. Nelson, Wildwood, MO (US)

(73) Assignee: Continental AFA Dispensing Company, Saint Peters, MO (US)

( * ) Notice: Subject to any disclaimer, the term of this patent is extended or adjusted under 35 U.S.C. 154(b) by 0 days.

(21) Appl. No.: 10/387,893

(22) Filed: Mar. 12, 2003

(65) Prior Publication Data

US 2004/0178223 A1 Sep. 16, 2004

(51) Int. Cl.[7] ..... B67D 5/00

(52) U.S. Cl. ..... 222/153.13; 222/179.5; 222/324; 222/383.1; 222/383.3; 222/464.3; 222/530; 239/333

(58) Field of Search ..... 222/153.11, 153.13, 222/179.5, 324, 383.1, 383.3, 385, 464.1, 464.3, 527, 464.4, 530, 464.5, 538, 333

(56) References Cited

U.S. PATENT DOCUMENTS

| | | | | | |
|---|---|---|---|---|---|
| 3,240,398 | A | * | 3/1966 | Dalton, Jr. | 222/630 |
| 5,373,973 | A | | 12/1994 | Foster | 222/324 |
| 5,469,993 | A | * | 11/1995 | Hauf et al. | 222/383.3 |
| 5,485,942 | A | | 1/1996 | Foster | 222/324 |
| 5,553,750 | A | | 9/1996 | Foster | 222/179.5 |
| 5,655,714 | A | * | 8/1997 | Kieffer et al. | 239/318 |
| 6,508,410 | B1 | * | 1/2003 | Thomas et al. | 239/1 |
| 2002/0070245 | A1 | * | 6/2002 | Barriac et al. | 222/382 |

* cited by examiner

*Primary Examiner*—J. Casimer Jacyna
(74) *Attorney, Agent, or Firm*—Thompson Coburn, LLP

(57) ABSTRACT

A liquid dispensing assembly includes a hand-operated trigger sprayer that is removably attached to a bottle container and communicates with the bottle container through a length of conduit. The trigger sprayer can be securely attached to the bottle container by a child proof connection with the length of conduit stored in an interior volume of the handle of the trigger sprayer or with the length of conduit positioned on the exterior of the trigger sprayer handle and the bottle container.

22 Claims, 10 Drawing Sheets

CHILD PROOF CONNECTION FOR REMOTE TRIGGER SPRAYER AND BOTTLE CONTAINER

BACKGROUND OF THE INVENTION (1) Field of the Invention

The present invention pertains to a liquid dispensing assembly that comprises a hand held and hand operated trigger sprayer dispenser and a separate bottle container that communicate with each other through a length of conduit. More specifically, the present invention pertains to a trigger sprayer that is removably attached to a bottle containing a liquid to be dispensed by the trigger sprayer where a length of conduit communicates the trigger sprayer with the bottle contents and the trigger sprayer is removably attached to the bottle by a child proof connection.

(2) Description of the Related Art

Hand held and hand operated trigger sprayers that are employed in dispensing large quantities of a liquid, for example in dispensing a garden fertilizer or an insecticide are typically used with a large bottle container that contains a large quantity of the dispensed liquid, for example a gallon of the liquid. The bottle container communicates with the trigger sprayer through an elongate length of conduit or tubing. The length of the conduit enables the user to freely manipulate the trigger sprayer in one hand in dispensing the liquid from the bottle while holding the bottle in the other hand. Examples of these types of trigger sprayer and bottle container assemblies are disclosed in the Foster U.S. Pat. Nos. 5,373,973; 5,485,942 and 5,553,750, each of which is incorporated herein by reference.

In the trigger sprayer and bottle container assemblies described above, at least a portion of the length of conduit communicating the trigger sprayer with the bottle interior is typically stored inside the bottle when the sprayer and bottle are not in use. In one embodiment the length of the conduit extending from the trigger sprayer is fed through a sealed opening in the cap of the bottle so that a majority of the length of the conduit is stored inside the bottle when the trigger sprayer is not being used. The trigger sprayer has a handle with a connector, for example a screw threaded connector or a bayonet-type connector, that attaches the trigger sprayer handle to the bottle opening or bottle neck when the trigger sprayer is not being used.

In another embodiment a cylindrical conduit container or adapter is inserted into the bottle opening and is connected to the bottle neck. The length of the conduit is inserted into the interior of the adapter and the trigger sprayer handle is attached to the top of the adapter when not in use.

Although the embodiments of the remotely operated trigger sprayer and bottle container described above provide an orderly way of storing the trigger sprayer, bottle container and interconnecting length of conduit when not in use, the task of threading the length of conduit back into the container interior or positioning the length of conduit into the adapter interior can be tedious to some individuals.

In addition, although child resistant locks and closures have been employed on trigger sprayers, in liquid dispensing assemblies comprising a remotely operated trigger sprayer and a bottle container connected by a length of conduit, it would be desirable to have a child resistant lock that attaches the trigger sprayer to the bottle container.

SUMMARY OF THE INVENTION

The liquid dispensing assembly of the invention overcomes the disadvantages associated with prior art dispensing assemblies by providing a child proof connection between the remotely operated trigger sprayer and the bottle container. The liquid dispensing assembly of the invention also provides an alternative to storing the length of conduit in the bottle container or in an adapter in the container, where the length of conduit can be easily stored outside the bottle container and outside the trigger sprayer handle.

The liquid dispensing assembly of the invention is similar to assemblies of the prior art in that it is basically comprised of a bottle container, a hand held and hand operated trigger sprayer, a connector that attaches the trigger sprayer to the container, and a length of conduit communicating the interior of the bottle container with the trigger sprayer. As is done in the prior art, each of the component parts of the assembly is constructed from a plastic material.

The bottle container in the preferred embodiment has a capacity of at least one gallon of liquid to be dispensed by the dispensing assembly. The container is designed with a carrying handle at the top of the container. A pair of notches are formed in one side of the handle and are dimensioned to receive the nozzle and trigger of the trigger sprayer. A container opening adjacent the handle provides access to the container interior volume. A neck surrounds the container opening.

The connector has a cylindrical cup configuration and is attached to the container neck. The cup shaped portion of the connector extends downwardly through the container neck opening and into the interior volume of the container. The connector cup has a hollow interior volume that is dimensioned to receive a portion of the length of the conduit. A dip tube extends through the bottom of the connector cup into the container interior to a distal end of the dip tube positioned adjacent the bottom of the container. A pair of cavities are provided in the top surface of the connector on diametrically opposite sides of the connector cup. Vent holes extend through the connector from the bottom surfaces of the cavities. A resilient locking tab projects upwardly from one side of the connector to a distal end of the tab positioned above the connector cup.

A lock ring is mounted on the connector and around the container opening for rotational movement of the lock ring relative to the connector and relative to the container. The lock ring has a pair of radially outwardly projecting flanges on opposite sides of the lock ring. A projection on the exterior surface of the lock ring engages with the connector locking tab in a first, locked position of the lock ring on the connector, preventing the lock ring from being moved from the first position. Manually bending the locking tab distal end away from the lock ring releases the projection from the locking tab and enables the lock ring to be rotated from its first position relative to the connector to a second, opened position of the lock ring relative to the connector.

The trigger sprayer has a hollow handle with a cylindrical side wall. An opening at a bottom end of the side wall provides access to an interior volume of the handle. A pair of legs project downwardly from the handle on opposite sides of the handle opening. The pair of legs are positioned to engage in the pair of connector cavities when the handle is attached to the connector. The handle interior surface has a pair of radially inwardly extending ridges on opposite sides of the handle interior volume. The handle ridges are positioned to engage with the lock ring flanges when the lock ring is in its first position to lock the handle to the connector.

A slot is provided in the handle side wall extending upwardly from the bottom opening of the handle. The slot is dimensioned to receive a portion of the length of the conduit extending through the side wall slot, enabling the conduit to be positioned outside the handle interior volume when the handle is locked to the connector.

In use of the liquid dispensing assembly of the invention, with the trigger sprayer attached to the connector and the connector attached to the opening of the liquid container, the locking tab distal end is first manually deflected away from the lock ring to enable rotation of the lock ring relative to the connector. The lock ring is then rotated from its first, locked position on the connector to its second, opened position, thereby disengaging the lock ring flanges from the trigger sprayer handle ridges. This enables the trigger sprayer to be pulled upwardly away from the connector and the liquid container for remote operation of the trigger sprayer. Removing the trigger sprayer from the connector pulls a portion of the length of conduit out of the trigger sprayer handle interior and out of the connector interior. Removing the trigger sprayer from the connector also removes the handle legs from the connector cavities, opening the vent holes of the connector and enabling air from the exterior environment of the liquid dispensing assembly to enter into the interior volume of the container.

After operation of the trigger sprayer the length of conduit removed from the handle and connector interior volumes is then positioned back into the interior volumes. Alternatively, the length of conduit removed from the handle and connector interior volumes is positioned through the slot in the handle side wall. The trigger sprayer handle is then assembled to the connector with the pair of handle legs extending into the pair of cavities in the connector. The trigger sprayer nozzle cap and trigger also engage in the pair of notches in the bottle container. The lock ring is then moved from its second position back to its first position where the pair of flanges of the lock ring engage with the pair of ridges on the trigger sprayer handle locking the handle to the connector. As the lock ring is moved to its first position the distal end of the locking tab engages over the projection on the exterior surface of the lock ring re-establishing the child proof connection between the connector and the lock ring that prevents the lock ring from being rotated.

The liquid dispensing assembly of the invention provides the advantages of two alternative ways of storing the length of conduit communicating the container interior with the trigger sprayer. The conduit can be stored either inside the connector interior volume and handle interior volume, or with the conduit stored extending through the slot in the trigger sprayer handle side wall to the exterior of the connector and the handle. In addition, the liquid dispensing assembly of the invention also provides the advantage of a child proof connection between the connector and the trigger sprayer handle.

BRIEF DESCRIPTIONS OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

The liquid dispensing assembly of the invention is basically comprised of a bottle container 12, a trigger sprayer 14, a length of conduit 16 that extends from the trigger sprayer 14 to the interior of the bottle container 12 and a connector 18 that removably attaches the trigger sprayer to the bottle container. The configuration of the bottle container 12 and the connector 18 to be described overcome disadvantages associated with prior art dispensing assemblies by providing a child proof connection between the remotely operated trigger sprayer 14 and the bottle container 12. The configuration of the trigger sprayer 14 to be described also overcomes disadvantages associated with prior art dispensing assemblies by providing an alternative to storing the length of conduit of the trigger sprayer in the bottle container or in an adapter in the bottle container, where the length of conduit can be easily stored outside the bottle container and outside the trigger sprayer handle. Each of the component parts of the dispensing assembly to be described are constructed of a plastic material as is conventional in the prior art.

Figure 2:
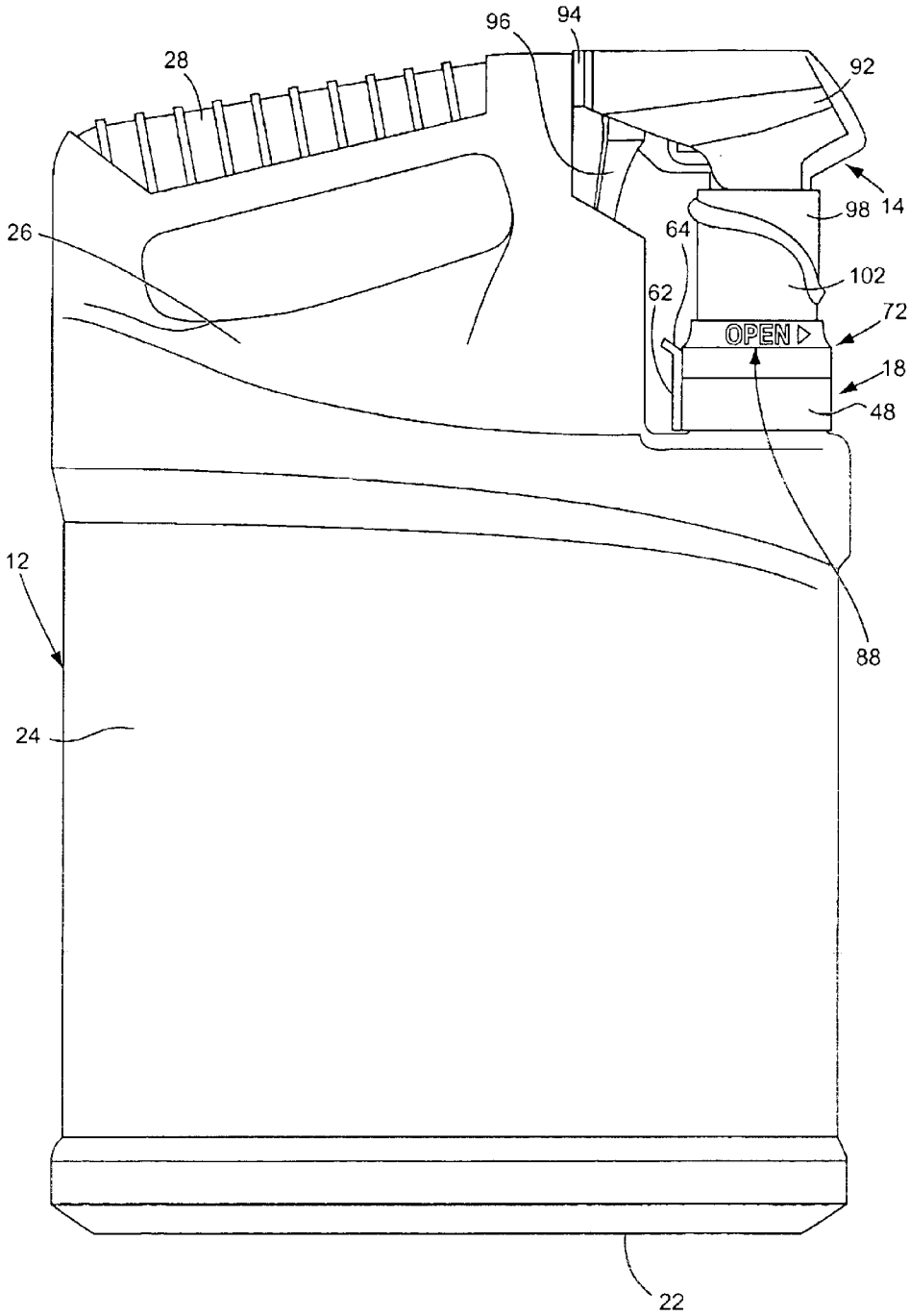
FIG. 2 is a side elevation view of the dispensing assembly.

The bottle container 12 has a construction that is typical among liquid dispenser assemblies of this type. The bottle container 12 is molded with a flat bottom surface 22 that can be placed on another separate surface to support the bottle container in an upright orientation shown in FIG. 2. A side wall 24 extends upwardly from the container bottom surface 22 and surrounds an interior volume of the bottle container. The bottle container is molded with a top surface 26 having an integral handle 28. The top surface is also formed with a cylindrical bottle neck 32 that surrounds an access opening to the interior of the bottle container.

The construction of the bottle container 12 of the invention differs from that of prior art bottle containers in that the preferred embodiment of the bottle container neck 32 has an attachment mechanism 34 formed in the interior surface of the bottle neck. In the preferred embodiment the attachment mechanism 34 is formed as internal screw threading. However, another equivalent type of connection could be used instead.

A pair of notches 36, 38 are formed in the top surface 26 of the bottle container. A first of the notches 36 is formed adjacent the top of the bottle container handle 28 and is positioned to receive the nozzle of the trigger sprayer when the trigger sprayer is attached to the bottle container. A second of the notches 38 is formed in the side of the bottle container handle 28 below the first notch 36 and is positioned to receive the trigger of the trigger sprayer when the trigger sprayer is attached to the bottle container.

Figure 4:
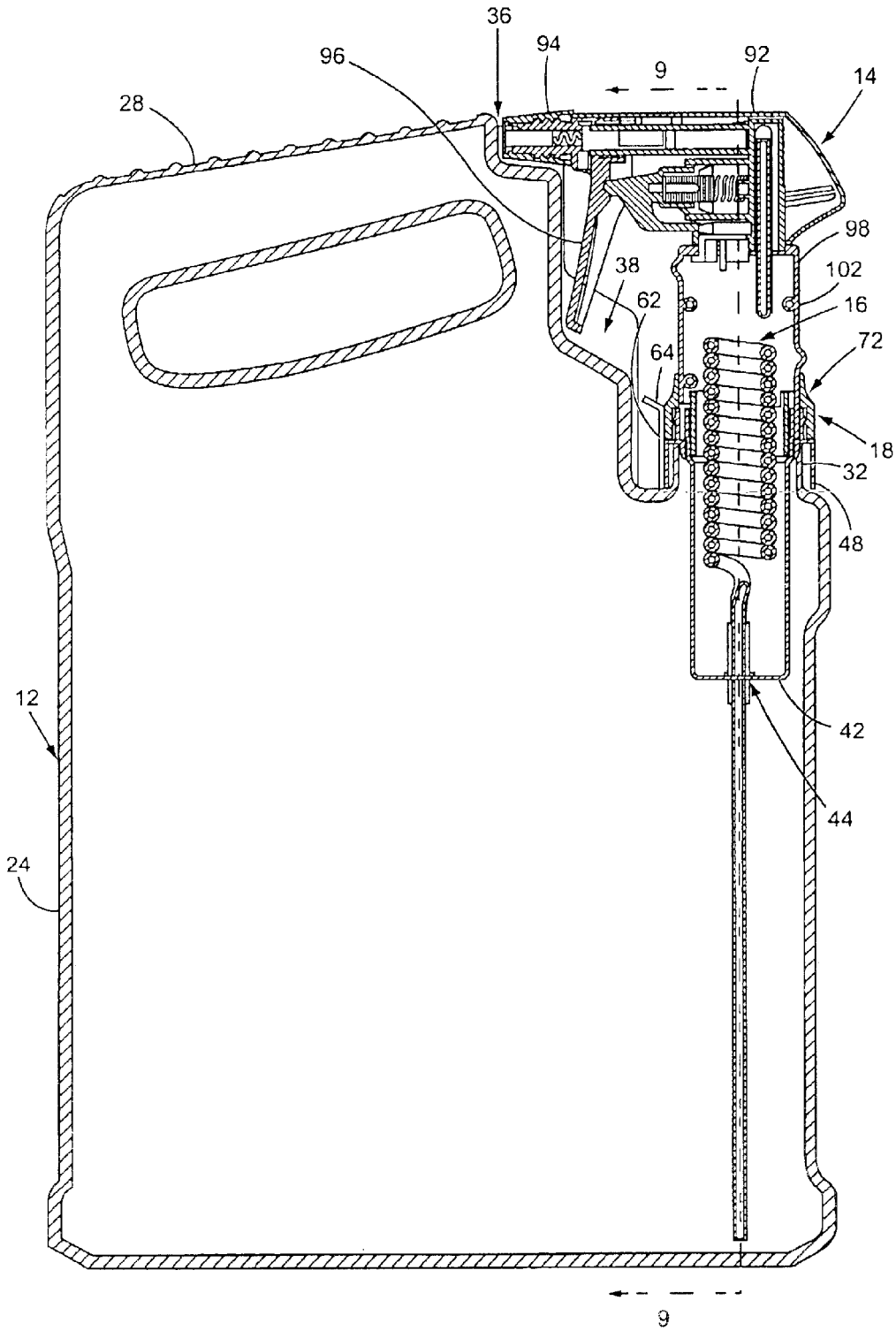
FIG. 4 is a side sectioned elevation view of the dispensing assembly.
Figure 5:
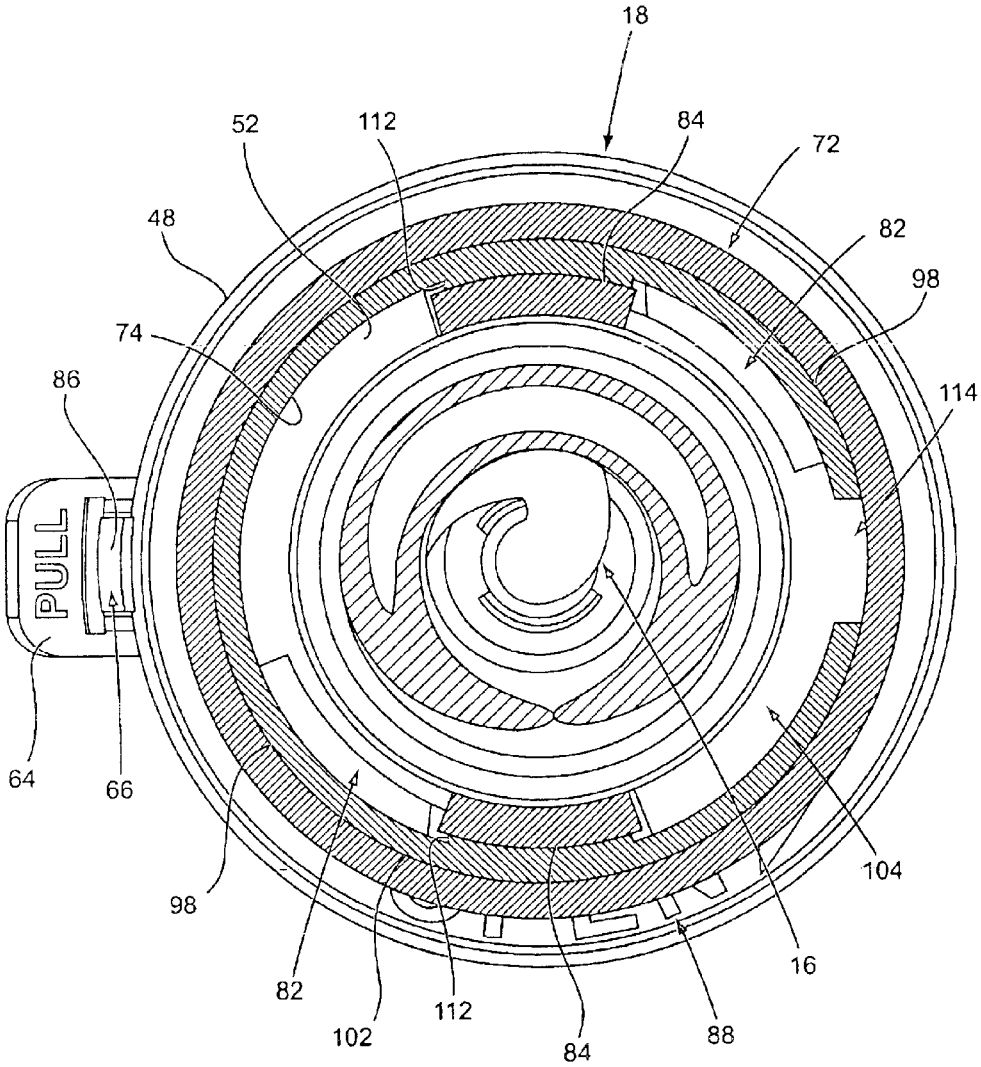
FIG. 5 is a plan sectioned view of portions of the connector, a lock ring, and the trigger sprayer handle in the locked position of the lock ring.
Figure 6:
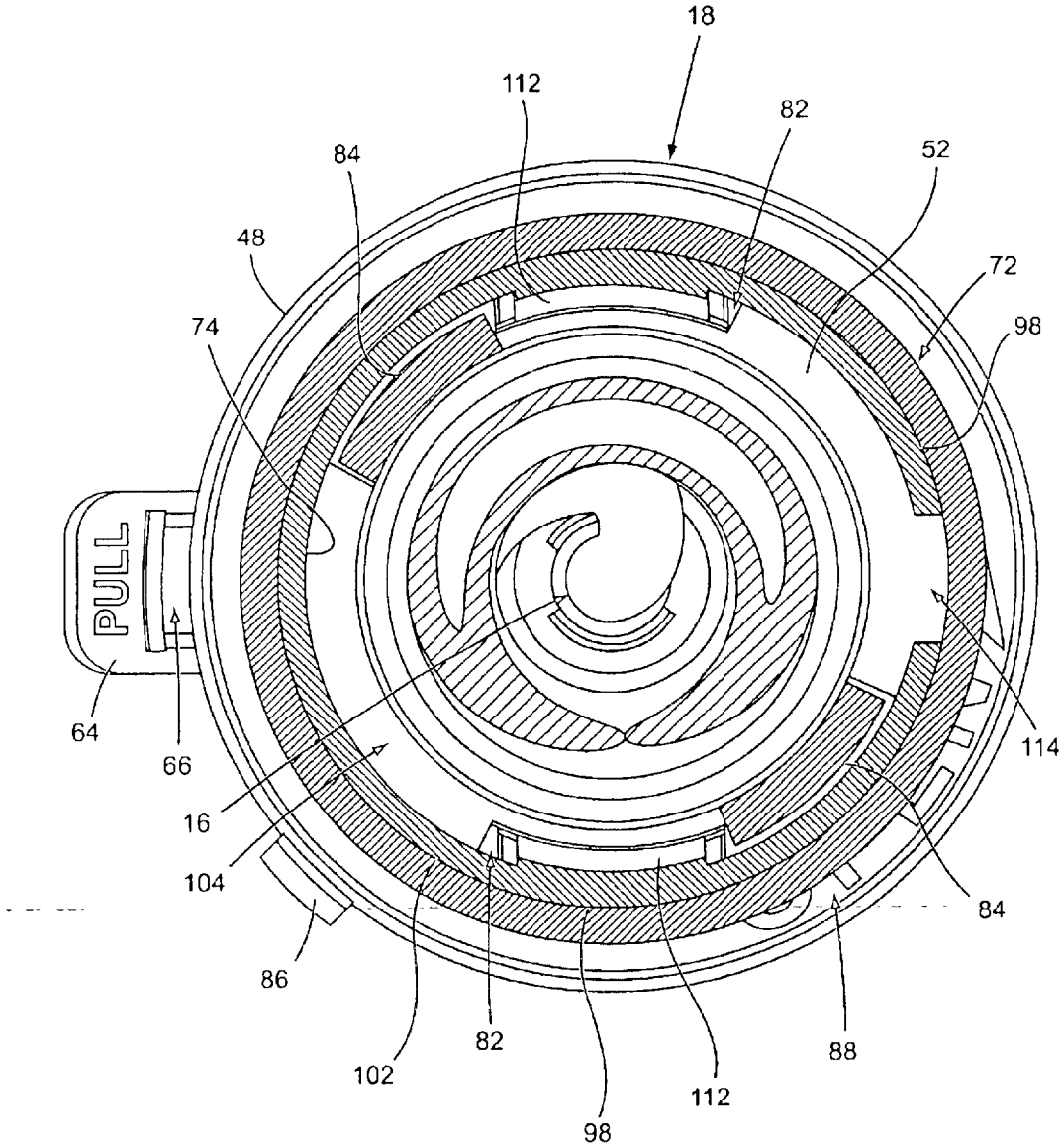
FIG. 6 is a plan view similar to that of FIG. 5, but showing the lock ring moved to its unlocked position.

The connector 18 is formed with an elongate cylindrical cup 42 at the bottom of the connector. The cup 42 has a hollow interior volume dimensioned to receive a substantial portion of the coiled conduit 16 of the trigger sprayer in storing the conduit in the connector cup. A hole 46 is provided at the bottom of the cup and a length of the conduit 16 extends through the hole to the bottom surface 22 of the bottle container as shown in FIG. 4. The exterior surface of the connector cup adjacent the top of the connector is provided with external screw threading 46 that is complementary to the internal screw threading 34 of the bottle container neck 32. The connector external screw threading 46 is mated with the bottle container neck internal screw threading 34 to removably attach the connector 18 to the bottle container 12. An outer cylindrical wall 48 of the connector 18 extends around the outside of the bottle container neck 32 and provides a surface that can be manually gripped to screw the connector 18 onto the bottle neck 32 or remove the connector from the bottle neck.

Figure 10:
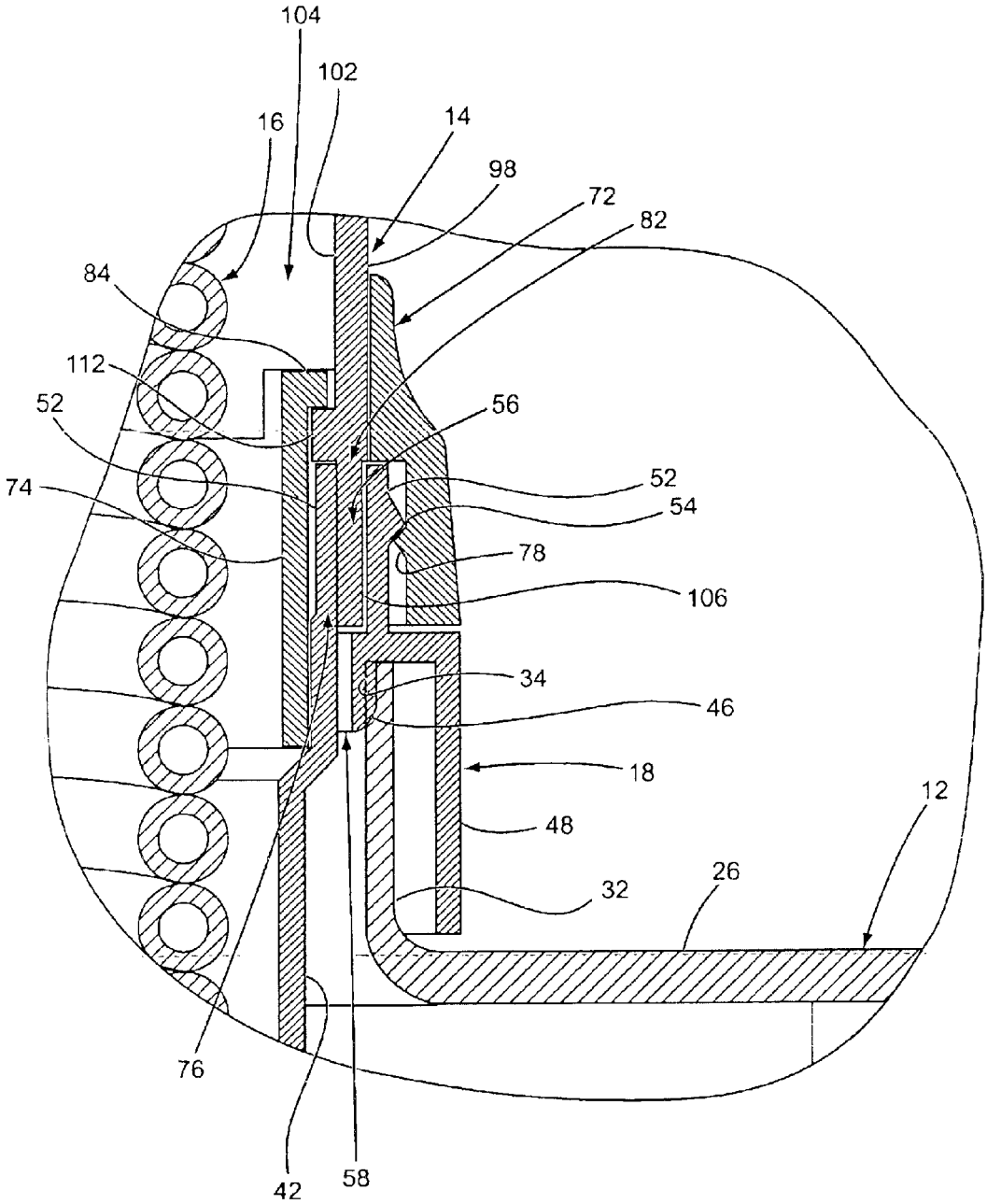
FIG. 10 is an enlarged partial view, in section, of portions of the bottle container, the connector, the lock ring, and the trigger sprayer handle shown in the circle 10 in FIG. 9.

The connector 16 has a cylindrical upper wall 52 that extends around a top opening of the connector. The connector upper wall 52 has an exterior surface and an annular rim 54 projects radially outwardly from the exterior surface. A pair of cavities 56 extend downwardly through a top surface of the upper wall 52 and into the upper wall 52 on diametrically opposite sides of the connector opening. A pair of vent holes 58 extend downwardly from the bottoms of the upper wall cavities 56 completely through the connector upper wall 52. The vent holes 58 are provided to vent the interior of the bottle container 12 through the vent holes and the cavities 56 as can be seen in FIG. 10.

Figure 7:
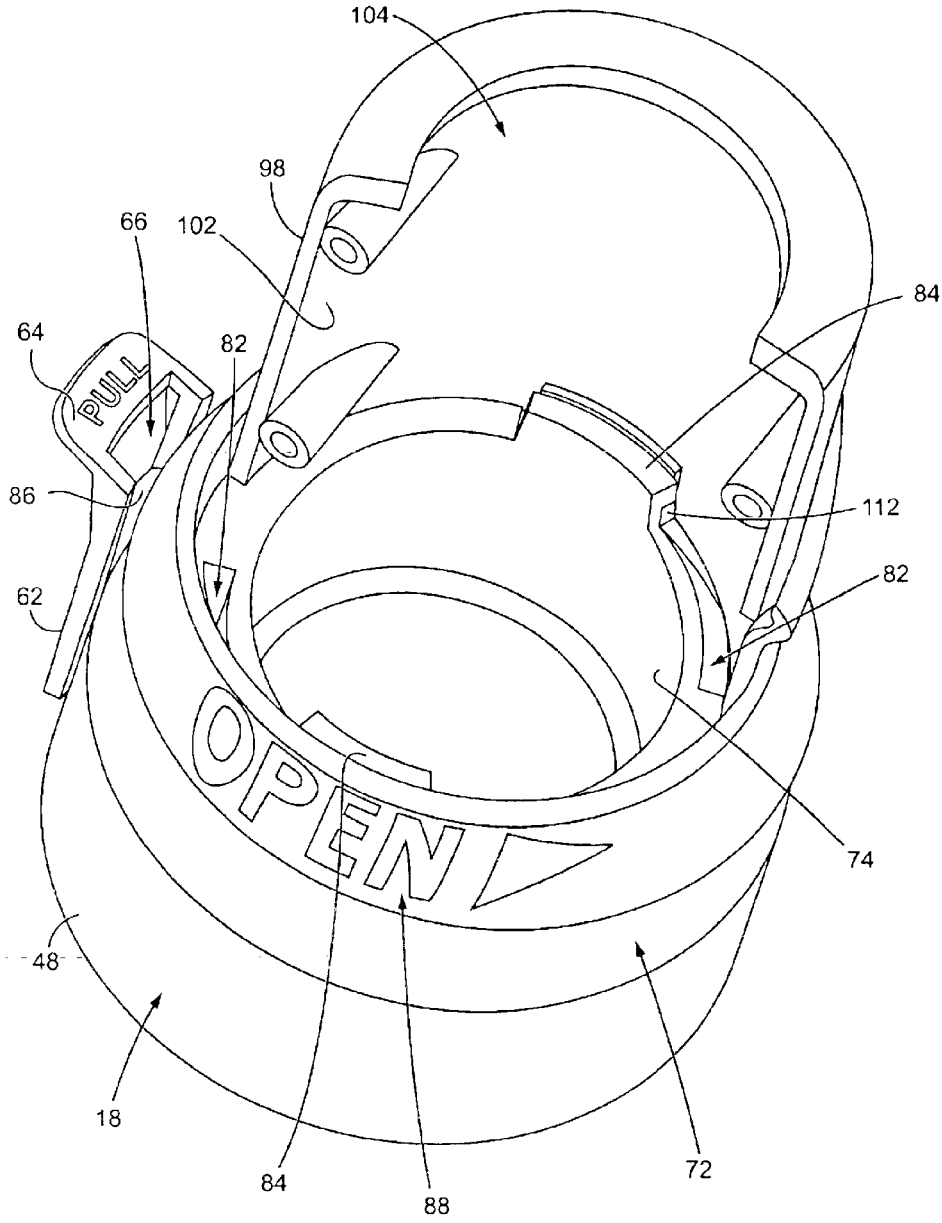
FIG. 7 is a partial view of the locking ring and trigger sprayer handle in the locked position of the locking ring.
Figure 8:
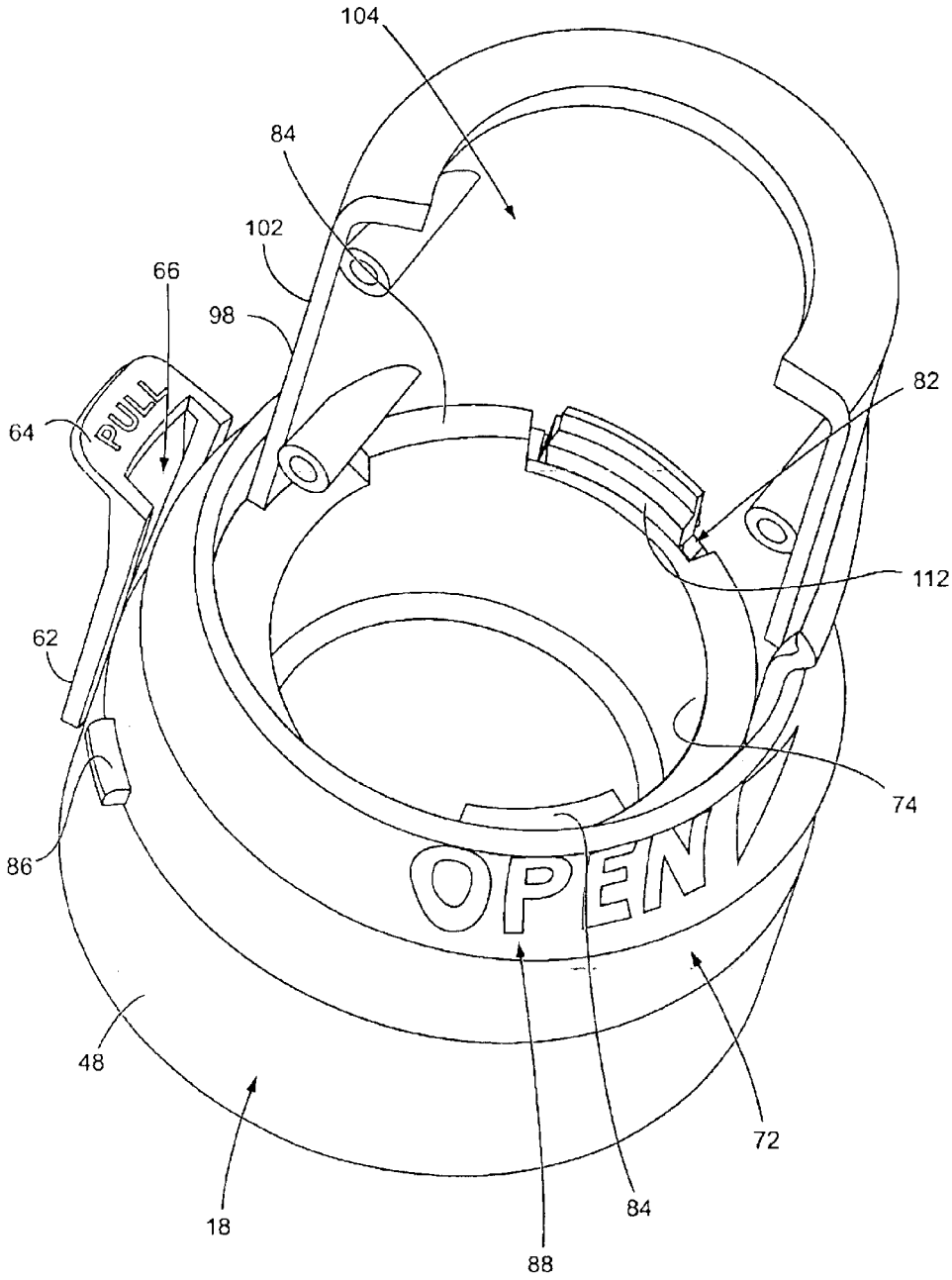
FIG. 8 is a view similar to that of FIG. 7, but showing the lock ring moved to its unlocked position.

The connector 18 is also provided with a locking tab 62. The locking tab 62 projects upwardly from a proximal end of the tab attached to the connector outer wall 48 to a distal top end 64 of the tab. An opening 66 is provided through the locking tab 62. The length of the tab 62 to its distal end 64 gives the tab a resilience that enables the tab to be manually bent, radially outwardly away from the connector outer wall 48. The resilience of the tab moves the tab back to its at rest position shown in FIGS. 7 and 8 when the tab distal end 64 is released.

A lock ring 72 is mounted on the connector 18 for rotation of the lock ring relative to the connector. The lock ring 72 has a cylindrical inner wall 74 that surrounds an open center bore of the lock ring through which the conduit 16 passes. The exterior surface of the lock ring inner wall 74 engages in sliding engagement with the interior surface of the connector upper wall 52.

Figure 9:
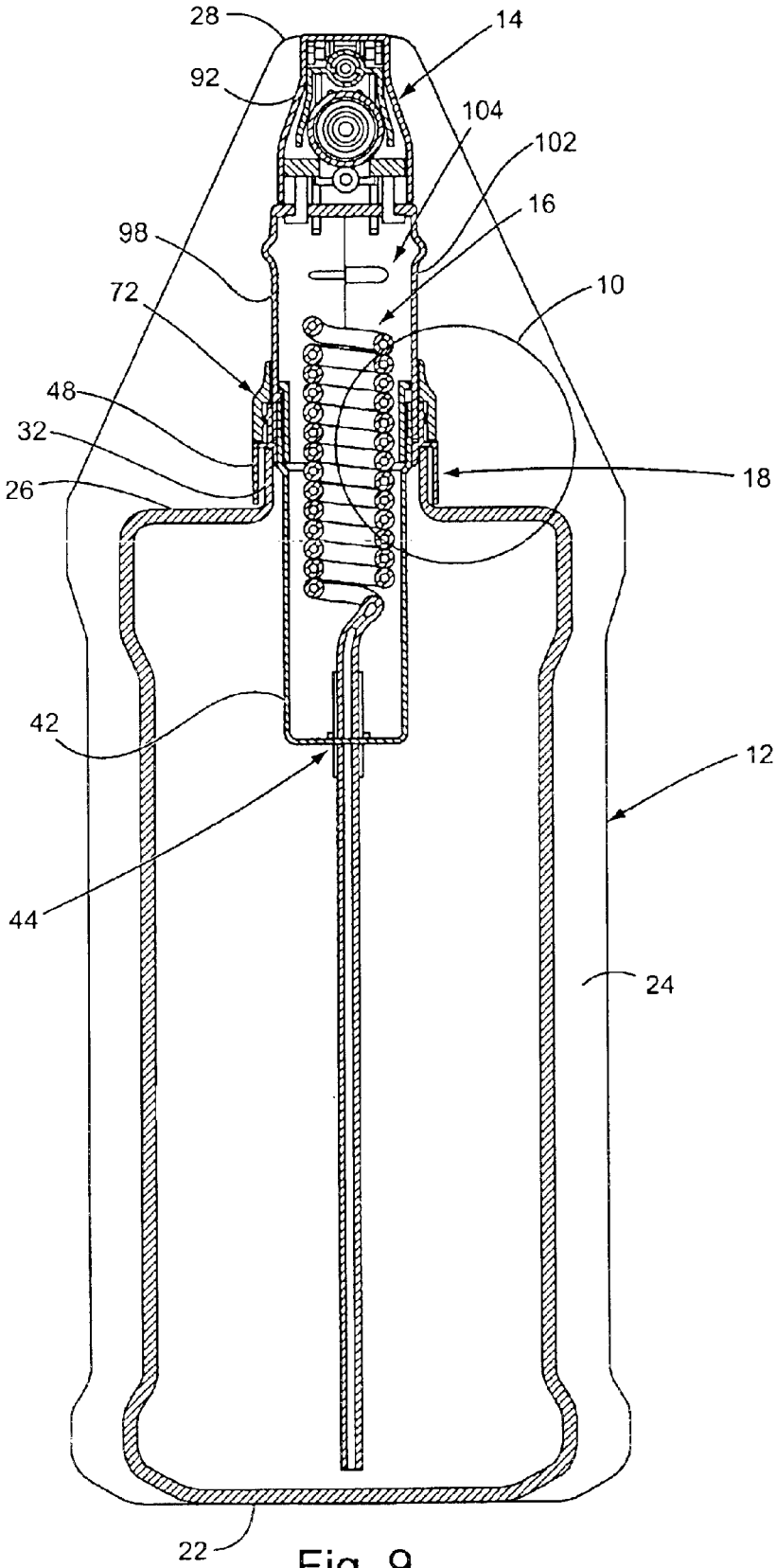
FIG. 9 is an end elevation view, partially in section, of the bottle container, trigger sprayer, and connector.

An annular cavity 76 is formed into the bottom of the lock ring 72 just. outside the lock ring inner wall 74. As seen in FIGS. 4, 9, and 10, the annular cavity 76 receives the upper cylindrical wall 52 of the connector 18. And annular rim 78 projects into the annular cavity 76 of the lock ring. As seen in FIG. 10, the annular rim 78 in the lock ring cavity 76 snaps over the annular rim 54 of the connector upper wall 52 in mounting the lock ring 72 to the connector 18 for rotation of the lock ring relative to the connector.

A pair of diametrically opposed arcuate slots 82 are formed in the top surface of the lock ring 72. The arcuate slots 82 extend downwardly through the lock ring to the annular cavity 76. The slots 82 are located on the lock ring where they will align with the pair of diametrically opposed cavities 56 in the connector upper wall 52. Each of the arcuate slots 82 has a length that is slightly larger than the lengths of the connector upper wall cavities 56.

A pair of diametrically opposed arcuate flanges 84 project outwardly from the top of the lock ring inner wall 74. The arcuate flanges 84 are positioned above the lock ring arcuate slots 82 but are shorter in length than the lengths of the arcuate slots. The arcuate flanges 84 have lengths that are less than half of the lengths of the arcuate slots 82.

The exterior of the lock ring 72 has a projection 86 that projects outwardly from the lock ring. The projection 86 is dimensioned to be received in the locking tab opening 66 of the connector 18. Engagement of the projection 86 in the locking tab opening 66 prevents the lock ring 72 from rotating relative to the connector 18. Manually deflecting the locking tab 62 away from the projection 86 allows the lock ring 72 to be turned or rotated relative to the connector 18. The lock ring 72 is also provided with indicia 88 on its exterior surface that indicates the direction of rotation of the lock ring 72 relative to the connector 18 to move the lock ring to its open position relative to the connector.

The trigger sprayer 14 is basically the same in construction as prior art trigger sprayers and therefore is not described in detail. As is conventional, the trigger sprayer 14 includes a sprayer housing 92, a nozzle 94 for adjusting the pattern of liquid discharge from the trigger sprayer and a trigger 96 that is manipulated to pump liquid from the container and discharge the liquid from the trigger sprayer. The novel feature of the trigger sprayer 14 is the handle 98 attached to the trigger sprayer.

The handle 98 has a cylindrical side wall 102 that surrounds a hollow interior volume 104 of the handle. The handle interior volume 104 is dimensioned to receive a portion of the conduit 16 coiled in the interior of the handle. As seen in FIGS. 4 and 9, with the handle 98 attached to the connector 18, a majority of the length of the conduit 16 communicating the trigger sprayer 14 with the interior of the bottle container 12 is contained in the interior volume 104 of the handle and the interior volume of the connector 18.

A pair of legs or tabs 106 project downwardly from the bottom edge of the handle side wall 102. The legs 106 are positioned on diametrically opposite sides of the handle side wall 102 and are dimensioned to be received in the cavities 56 in the upper wall 52 of the connector 18 as shown in FIGS. 9 and 10. The engagement of the legs 106 in the connector cavities 56 mounts the trigger sprayer 14 to the bottle container 12 in a predetermined orientation of the trigger sprayer 14 relative to the bottle container. This predetermined orientation also positions the trigger sprayer nozzle 94 in the nozzle notch 36 of the bottle container 12 and positions the trigger 96 in the trigger notch 38 of the bottle container. The engagement of the legs 104 in the connector cavities 56 and the positioning of the trigger sprayer nozzle 94 in the nozzle notch 36 and the positioning of the trigger sprayer trigger 96 in the trigger notch 38 prevents the trigger sprayer 14 from being rotated relative to the bottle container 12 when the trigger sprayer is mounted on the bottle container.

A pair of ridges 112 project inwardly from the interior surface of the trigger sprayer handle 98. The ridges 112 are positioned just above the pair of legs 106 that project downwardly from the bottom edge of the handle. As seen in FIG. 10, the ridges 112 are positioned where they will extend inwardly above the top edge of the connector upper wall 52 and beneath the pair of flanges 84 of the lock ring 72 when the lock ring is moved to its closed or locked position. Thus, the positioning of the lock ring flanges 84 above the ridges 112 on the trigger sprayer handle 98 prevents the trigger sprayer from being removed from the connector 18 and the bottle container 12.

Figure 1:
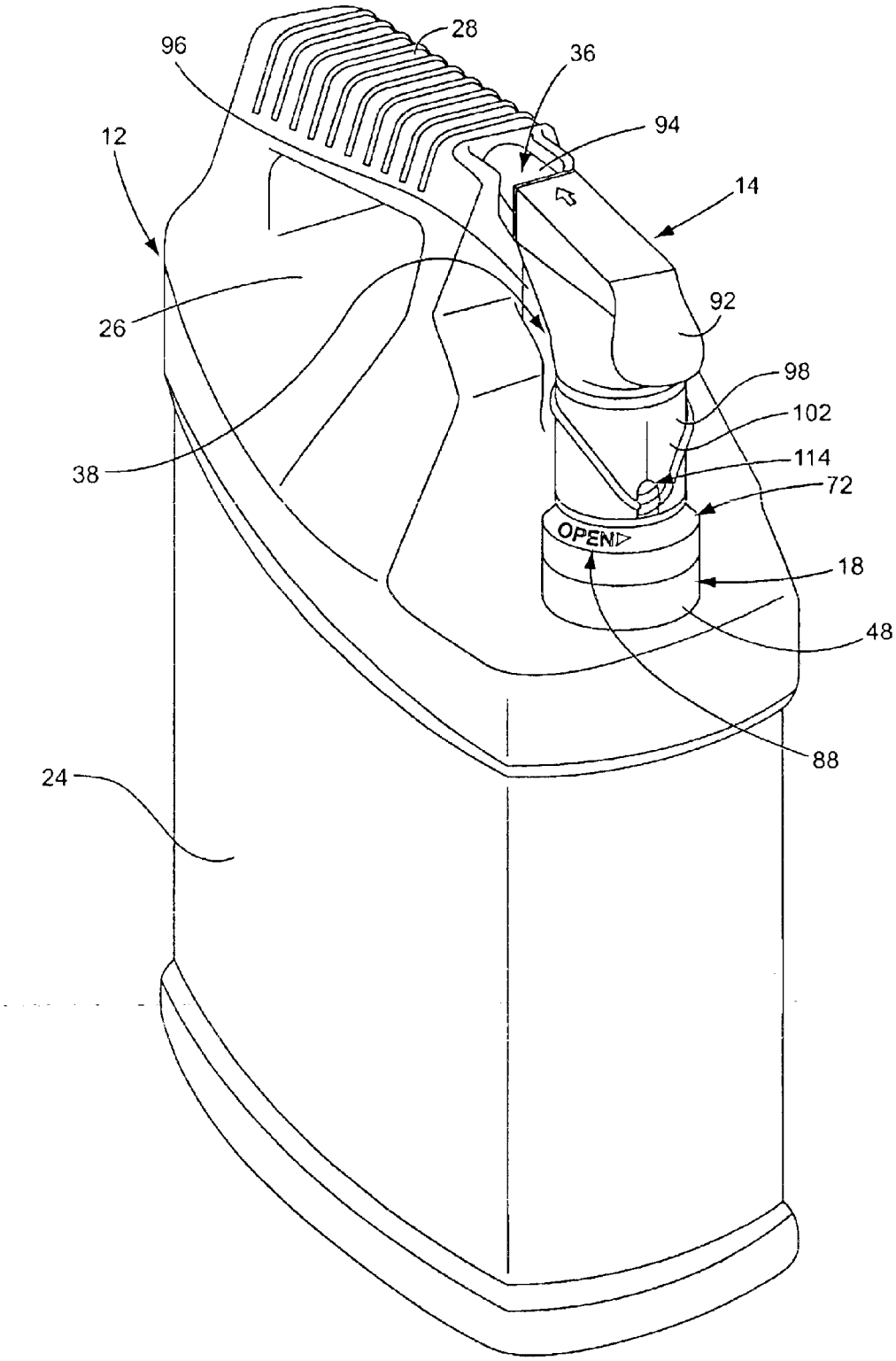
FIG. 1 is a side perspective view of the dispensing assembly of the invention showing the bottle container, the trigger sprayer and the connector that removably attaches the trigger sprayer to the container.
Figure 3:
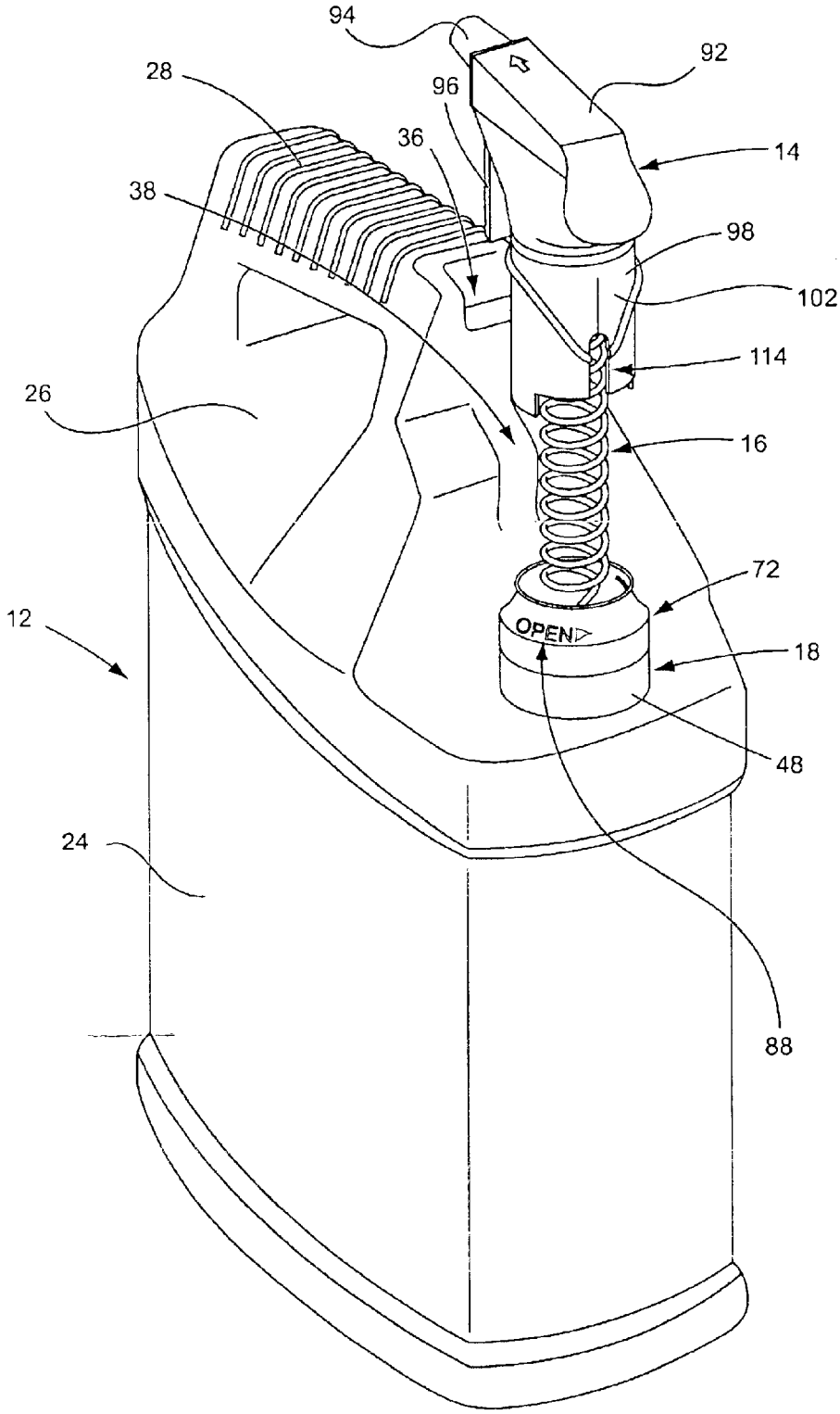
FIG. 3 is a view similar to that of FIG. 1, but showing the trigger sprayer detached from the connector and the bottle container.

As best seen in FIGS. 1 and 3, the trigger sprayer handle 98 also has a slot 114 formed in the handle side wall 102. The slot 114 extends upwardly a short distance through the side wall 102 from the bottom edge of the side wall. The slot 114 is dimensioned to enable a portion of the length of the conduit 16 to be extended through the slot 114 when attaching the trigger sprayer handle 98 to the connector 18 to allow the portion of the conduit 16 to extend outside of the interior volumes of the handle 98 and connector 18 when the trigger sprayer 14 is locked to the bottle container 12.

In use of the liquid dispensing assembly of the invention, with the trigger sprayer 14 attached to the connector 18 and the connector 18 attached to the bottle container 12, the locking tab distal end 64 is first manually deflected away from the lock ring 72 to disengage the lock ring projection 86 from the locking tab opening 66. The lock ring 72 may then be rotated from its locked position shown in FIG. 7 to its unlocked or open position shown in FIG. 8. This disengages the lock ring flanges 84 from the trigger sprayer handle ridges 112 unlocking the trigger sprayer 14 from the connector 18 and the bottle container 12. This enables the trigger sprayer 14 to be pulled upwardly away from the connector 18 and the bottle container 12 for remote operation of the trigger sprayer. Removing the trigger sprayer 14 from the connector 18 pulls a portion of the length of the conduit 16 out of the interior volume of the trigger sprayer handle 98 and out of the interior volume of the connector 18. Removing the trigger sprayer 14 from the connector 18 also disengages the trigger sprayer handle legs 106 from the connector cavities 56, opening the vent holes 58 at the bottoms of the connector cavities to vent the interior of the bottle container 12.

After operation of the trigger sprayer 14 the length of conduit 16 removed from the interior of the trigger sprayer handle 98 and the interior of the connector 18 can be positioned back into the interior volumes of the trigger sprayer handle 98 and the connector 18 as the trigger sprayer handle is attached to the connector. Alternatively, the length of the conduit 16 removed from the handle and the connector can be positioned through the slot 114 in the trigger sprayer handle side wall 102. The trigger sprayer handle 98 is then assembled to the connector 18 with the pair of handle legs 106 being inserted into the cavities 56 in the connector upper wall 52. The trigger sprayer nozzle 94 and trigger 96 are also positioned in the nozzle notch 36 and trigger notch 38 of the bottle container 12, respectively. The lock ring 72 is then moved from its opened position shown in FIG. 8 back to its closed or locked position shown in FIG. 7. This causes the lock ring flanges 84 to engage over the trigger sprayer handle ridges 112 locking the trigger sprayer 14 to the connector 18 and the container 12. As the lock ring 72 is moved, the locking tab 62 is deflected outwardly so that the lock ring projection 86 is positioned opposite the locking tab opening 66. Releasing the locking tab 62 engages the lock ring projection 86 in the locking tab opening 66 re-establishing the child proof connection between the connector 18 and the lock ring 72 that prevents the lock ring from being rotated.

The liquid dispensing assembly described above provides the advantages of two alternative ways of storing the length of conduit 16 communicating the interior of the bottle container 12 with the trigger sprayer 14. The conduit can be stored either inside the interiors of the trigger sprayer handle 94 and connector 18, or can be stored extending through the handle slot 114 on the exterior of the trigger sprayer 14 and bottle container 12. In addition, the liquid dispensing assembly of the invention also provides the child proof connection between the connector 18 and trigger sprayer 14.

While the present invention has been described by reference to a specific embodiment, it should be understood that modifications and variations of the invention may be constructed without departing from the scope of the invention defined in the following claims.

What is claimed is:

1. A liquid dispensing assembly comprising:

a container having an interior volume and an opening providing access to the container interior volume;

a lock ring mounted on the container around the container opening for rotation of the lock ring around the container opening between first and second positions of the lock ring on the container;

a manually operated trigger sprayer that is separate from the container and the lock ring, the trigger sprayer having a handle that is insertable into the lock ring, the handle being connected to the lock ring and the container in response to rotating the lock ring to the first position and the handle being removable from the lock ring and the container in response to rotating the lock ring to the second position.

2. The assembly of claim 1, further comprising:

a locking tab having a length with opposite proximal and distal ends, the locking tab proximal end being on the container adjacent the container opening and the locking tab distal end engaging with the lock ring when the lock ring is in the first position preventing the lock ring from rotating around the container opening.

3. The assembly of claim 2, further comprising:

the locking tab being resilient and being manually deflectable away from the lock ring to separate the locking tab distal end from the lock ring and enable rotation of the lock ring.

4. The assembly of claim 1, further comprising:

the handle having a hollow interior volume and a bottom opening in the handle providing access to the handle interior volume; and, a conduit having a length with opposite proximal and distal ends, the conduit distal end being extendable through the container opening and into the container interior volume and the conduit proximal end extending through the handle bottom opening and the handle interior volume and being connected to the trigger sprayer.

5. The assembly of claim 4, further comprising:

the handle having a side wall with a slot extending through the handle side wall from the handle bottom opening, the slot being dimensioned to enable the conduit to extend through the slot to outside the handle when the handle is connected to the lock ring.

6. The assembly of claim 1, further comprising:

a connector that is removably connected to the container over the container opening;

the lock ring being mounted on the connector for rotation of the lock ring on the connector; and, the trigger sprayer handle being mounted on the connector when the handle is inserted into the lock ring and the lock ring connecting the handle to the connector in response to rotating the lock ring to the first position and the lock ring disconnecting the handle from the connector in response to rotating the lock ring to the second position.

7. The assembly of claim 6, further comprising:

the connector having a vent hole through the connector that communicates with the container interior volume when the connector is connected to the container and the vent hole is positioned on the connector where the vent hole is closed when the trigger sprayer handle is connected to the connector and the vent hole is opened when the trigger sprayer handle is disconnected from the connector.

8. The assembly of claim 1, further comprising:

the handle having at least one leg projecting outwardly from the handle; and a cavity on the container, the cavity being positioned to receive the leg in the cavity when the handle is inserted into the lock ring where the leg received in the cavity holds the trigger sprayer against rotation relative to the container.

9. The assembly of claim 6, further comprising:

the handle having at least one leg projecting outwardly from the handle; and the connector having a cavity positioned on the connector to receive the leg of the handle in the cavity when the handle is inserted into the lock ring where the leg received in the cavity holds the trigger sprayer against rotation relative to the connector and the container.

10. The assembly of claim 1, further comprising:

a ridge projecting outwardly from the handle; and, a flange on the lock ring that engages with the handle ridge in response to rotating the lock ring to the first position and that disengages from the handle ridge in response to rotating the lock ring to the second position.

11. The assembly of claim 1, further comprising:

the container having a notch; and, the trigger sprayer having a trigger that extends into the container notch when the trigger sprayer handle is connected to the lock ring.

12. A liquid dispensing assembly comprising:

a container having an interior volume and an opening providing access to the container interior volume;

a conduit having a length with opposite proximal and distal ends, the conduit distal end being extendable through the container opening and into the container interior volume; and, a manually operated trigger sprayer connected to the conduit proximal end, the trigger sprayer having a handle that is connectable to the container over the container opening and the handle having a first opening through the handle that is dimensioned to receive the conduit extending through the opening to an exterior of the handle and an exterior of the container when the handle is connected to the container.

13. The assembly of claim 12, further comprising:

the handle having a hollow interior and a portion of the conduit length extending through the handle interior to the conduit proximal end.

14. The assembly of claim 12, further comprising:

the handle having a second opening that is aligned with the container opening when the handle is connected to the container.

15. The assembly of claim 14, further comprising:

the first opening and the second opening intersecting each other.

16. A liquid dispensing assembly comprising:

a container having an interior volume and an opening providing access to the container interior volume;

a conduit having a length with opposite proximal and distal ends, the conduit distal end being extendable through the container opening and into the container interior volume;

a manually operated trigger sprayer connected to the conduit proximal end, the trigger sprayer having a handle that is connectable to the container over the container opening and the handle having a first opening through the handle that is dimensioned to receive the conduit extending through the opening to an exterior of the handle when the handle is connected to the containers; and a lock ring that is mounted to the container around the container opening for rotation of the lock ring between first and second positions of the lock ring relative to the container, the lock ring being dimensioned to receive the trigger sprayer handle in the lock ring and the lock ring being connected to the handle in response to rotating the lock ring around the handle to the first position of the lock ring and the lock ring being disconnected from the handle in response to rotating the lock ring around the handle to the second position of the lock ring.

17. The assembly of claim 16, further comprising:

a ridge on the trigger sprayer handle and a flange on the lock ring that is positioned to engage with the ridge when the lock ring is rotated to the first position and to disengage from the ridge when the ring is rotated to the second position.

18. The assembly of claim 16, further comprising:

a locking tab having a length with opposite proximal and distal ends, the tab proximal end being mounted to the container with the tab distal end engaging against the lock ring when the lock ring is in the first position preventing rotation of the lock ring.

19. The assembly of claim 18, further comprising:

the locking tab distal end being manually separable from the lock ring to enable rotation of the lock ring.

20. A liquid dispensing assembly comprising:

a container having an interior volume and an opening providing access to the container interior volume;

a conduit having a length with opposite proximal and distal ends, the conduit distal end being extendable through the container opening and into the container interior volume;

a manually operated trigger sprayer connected to the conduit proximal end, the trigger sprayer having a handle that is connectable to the container over the container opening and the handle having a first opening through the handle that is dimensioned to receive the conduit extending through the opening to an exterior of the handle when the handle is connected to the containers; and a connector that is connectable to the container over the container opening;

the lock ring being mounted on the connector for rotation of the lock ring between the first and second positions on the connector; and the trigger sprayer handle being mounted on the connector when the handle is inserted into the lock ring, the lock ring connecting the handle to the connector in response to rotating the lock ring to the first position on the connector and the lock ring disconnecting the handle from the connector in response to rotating the lock ring to the second position on the connector.

21. The assembly of claim 18, further comprising:

the handle having at least one leg projecting outwardly from the handle; and the connector having a cavity that receives the handle leg when the handle is inserted into the lock ring and prevents the handle from rotating relative to the connector.

22. The assembly of claim 12, further comprising:

the container having a notch; and the trigger sprayer having a trigger that extends into the container notch when the trigger sprayer handle is connected to the container.

* * * * *